United States Patent [19]

Bailey

[11] Patent Number: 5,030,153

[45] Date of Patent: Jul. 9, 1991

[54] FLOTATION VEST

[75] Inventor: J. Trevor Bailey, Alma, Ga.

[73] Assignee: ERO Industries, Morton Grove, Ill.

[21] Appl. No.: 559,320

[22] Filed: Jul. 30, 1990

[51] Int. Cl.[5] ..... B63C 9/10

[52] U.S. Cl. ..... 441/115; 441/106; 441/108; 441/114

[58] Field of Search ..... 441/88, 106, 108, 111–119, 441/123, 129

[56] References Cited

U.S. PATENT DOCUMENTS

| | | | |
|---|---|---|---|
| 163,422 | 5/1875 | Traub | 441/15 |
| 1,064,743 | 6/1913 | Kepler | 441/115 |
| 1,480,417 | 1/1924 | Potter | 441/115 |
| 1,805,803 | 5/1931 | Bulgarini | 441/115 |
| 2,093,964 | 9/1937 | Hindle | 441/124 |
| 4,038,713 | 8/1977 | O'Link | 441/112 |
| 4,380,441 | 4/1983 | Harr | 441/112 |
| 4,619,622 | 10/1986 | MacDonald | 441/115 |
| 4,871,338 | 10/1987 | Hoffman | 441/108 |

*Primary Examiner*—Joseph F. Peters, Jr.
*Assistant Examiner*—Clifford T. Bartz
*Attorney, Agent, or Firm*—Lockwood Alex FitzGibbon & Cummings

[57] ABSTRACT

A flotation vest particularly adapted for use with children is provided in a vest body including a front panel and a pair of back panels each joined to the front panel so as to define an open back vest with a top neck opening and side arm hole openings. A head support portion is hingeably joined to the vest body along the neck opening at a forwardly displaced position. The head support portion includes left and right lobe-shaped collar portions extending on opposed sides of the neck opening to the top of the front panel. Continuous elongate opposing free edge portions extend the entire length of the back of the vest from the free end of the collar panels to the bottom of the rear panels. A releasable fastener requiring adult assistance for operation joins the opposing parts of the back of the vest to secure the vest to the child. Flotation inserts of a buoyant flotation material are provided in the front panel and in each of the collar panels to force the wearer into a chest-up floating position with the head raised and cradled to maintain the wearer's face in a nose-up out of the water position.

12 Claims, 1 Drawing Sheet

FLOTATION VEST

BACKGROUND OF THE INVENTION

The present invention generally relates to flotation vests classified by the United States Coast Guard as Type II—Near Shore Buoyant Vests. More particularly, it relates to a new and improved flotation vest of this type including an open back or rear side and having all size adjustment fixtures and releasable fasteners provided on the rear side of the vest for improved safety.

Prior art Type II—Near Shore Buoyant Vests are well known. The most common are bright orange in color and have an inverted U-shape or horse shoe-shaped configuration. Frequently referred to as "life preservers" in the past, Type II vests of this type have conventionally included three connected tubular or cylindrical flotation segments or lobes. The separate lobes include a horizontal top or upper cross piece adapted to be placed behind the head and two spaced apart vertical lobes hingedly attached to opposed ends of the top piece. The front vertical lobes are adapted to pass from behind the head across the shoulders forwardly and downwardly along the chest to about the wearer's waist. A waist strap or belt connected at one end to one of the vertical lobes is passed around the wearer's waist. The free end of the belt is threaded through a belt loop provided on the other vertical lobe and fastened, usually by means of a spring clip to a belt ring provided on the other vertical lobe. The belt length usually includes a cinch buckle adjustment to shorten or lengthen the belt. A pair of aligned tie straps are usually provided at about chest height on each of the vertical lobes for forming a chest tie which effectively brings the vertical lobes together to define a neck hole or opening. These tie straps are usually made of a woven, non-slip fabric material such as cotton. More than one pair of tie straps may be provided along the front portions of the vest. In these conventional Type II flotation vests, the flotation or buoyancy is provided by a filling of flotation material filling in each of the lobes. The filling may be a closed cell foam material in chopped, molded or sheet form.

Conventional life vests of this type have proven themselves useful and are perfectly adequate for most adult uses on or near the water. Nevertheless, special difficulties arise with Type II vests of this common style when the wearer is a small child or possibly a person with special needs. More particularly, each of the belt securement and tie strap structures are provided along the front of the vest which is a serious shortcoming. The frontal placement of the straps and belts permits a young child to intentionally or unintentionally undo them in use which may be very dangerous particularly in an in-the-water panic situation. The vests can only be effective if they are worn and if once properly installed they will remain in proper position on the wearer under various circumstances likely to be encountered in use.

A Type II flotation vest design generally includes a front or chest flotation portion secured to the wearer's upper body which is provided with sufficient flotation material to cause most wearers falling face first into the water to roll over into a chest-raised, back float position. The behind-the-head flotation lobe portions are intended to raise the head, face and ears of the wearer out of the water, to permit a person to remain in the water for a long period of time without becoming exhausted or drowning.

Efforts to improve upon the traditional U-shaped Type II flotation vest for children, have included providing a full vest configuration including front and back panels provided with a top neck hole and arm holes. A currently, commercially available embodiment includes a front zipper closure which separates the front flotation panel into left and right front flotation halves. These halves are bulky and in use they tend to make it difficult to install the vest on a wriggling two year old. In addition, the slide fastener hardware is placed in the front. This is a disadvantage because, the vest may tend to ride up in use, causing the zipper parts to contact the wearer's face and chin which is uncomfortable. The front placement of the closure provided on this device is also a distinct disadvantage because it can be unfastened by a young wearer.

In U.S. Pat. No. 4,038,713 another personal flotation device is described. The flotation vest described in this patent is of a Type II style and includes wrap-around front and back body panels with a rear tie closure. Front and rear flotation panels are provided in a collar structure which forces the wearer into a head-up, upright position in the water. The side portions of the vest body overlap but are open and although they define armholes, a struggling child may slip their arms in through the open sides of the vest. Moreover, a tie attachment at the rear of the vest is provided, which may disadvantageously become loosened, particularly in a panic situation. Loosening of the rear tie may cause the vest to come undone at a time when its protection is most needed.

Another prior art flotation vest is described in U.S. Pat. No. 4,380,441 to Harr et al. The flotation vest described in this patent is a front closure vest including foam back and front panels of the type used by water skiers to provide simple buoyancy. No life preservative effect of the Type II class is intended because the vest does not include a buoyant collar portion for raising the head above water. The lack of a collar section prevents the flotation vest from being self-righting in the life preserving manner of a Type II vest. The lack of a collar may cause or permit the wearer to turn turtle, i.e., to turn to a head down position in the water, without any structural means for turning rightside up. For most adult wearers who know how to swim and use their arms to tread water, these vests are adequate and are comfortable. Children may not be able to turn themselves rightside-up. The front closure for the life vest shown in the Harr et al. patent also provides a major shortcoming in connection with the use of the vest on small children or individuals with special needs, because the wearer can undo the vest or slip out of it.

Accordingly, it is an object of the present invention to provide a new and improved Type II flotation vest which cannot be intentionally or unintentionally unfastened by the wearer, but instead must usually be secured or released with the assistance of another person.

It is another object of the present invention to provide a Type II flotation vest including a buoyant bib section and collar section which effectively cradle the head of the wearer and maintain the wearer in a back float position with face and ears out of the water, thereby preventing panic and promoting the ability of the wearer to remain in the water for prolonged periods of time without having to struggle to keep themselves from being submerged.

It is a further object of the present invention to provide a personal flotation vest wherein all size adjustments and fastening hardware are placed at the rear or back panel of the vest to prevent unsafe or accidental unfastening.

It is still another object of the present invention to provide a flotation vest particularly adapted for use with young children capable of providing increased comfort both in and out of the water to the wearer, thereby promoting safety by ensuring that the child will keep the vest on.

SUMMARY OF THE INVENTION

In accordance with these and other objects, the present invention provides a new and improved flotation vest which comprises a plurality of pliable panels including a front panel, left rear panel and a right rear panel. The left rear panel and the right rear panel are each adjoined to the front panel along top seams and side seams to define a vest body having a solid front, a split open back, a top neck opening and a pair of side arm holes. The vest further includes a left collar panel and a right collar panel joined to said front panel and to respective left and right rear panels along a front seam disposed forwardly of the shoulders of the vest body on either side of the neck opening. The forward extension of the collar panels to the front seam on either side of the neck opening provides improved head lifting and support for the vest of this invention over prior art Type II Near Shore Buoyant Vests.

The front panel, left collar panel and right collar panel are each provided with internal pocket means. Buoyant flotation material is disposed in each of the pocket means to define an improved Type II personal flotation device. At the back of the vest, elongate left and right rear free edges are defined in opposing face to face relationship extending from a bottom edge portion of the vest to the top free ends of the left and right collar panels. These elongate rear free edge portions extend completely up and down the vertical length of the back of the vest body and attached collar portion. The rear free edges are provided with a releasable closure means of the type requiring an extra pair of hands for operation, to effectively join the left rear free edge portion to the right rear free edge portion in order to secure the flotation vest onto the wearer. Preferably, the rear releasable closure means will comprise a slide fastener or zipper which zips in a bottom to top direction along the entire length of the left rear and right rear free edge portions.

Each of the panels forming the new and improved flotation vest of the invention are preferably prepared as a double thickness of web material disposed in overlying, registering relationship and having a peripheral edge seam defined, usually by means of sewing or stitching continuously about the periphery thereof. Preferably, each of the webs are of a woven fabric material which is tough and can resist prolonged exposure to sunlight and soaking in water without loosing its mechanical integrity or shape dimensions. Preferably, the webs are made of a coated or noncoated woven fabric material selected from nylons, polyolefins, polyesters and other woven fabric materials.

In accordance with this invention, the front panel of the vest substantially covers the entire front bodice portion of the wearer from the neck down to the waist. The front panel includes a pocket formation defined between the webs of material forming the front panel which is adapted to receive flotation material. The buoyant flotation material may comprise chopped closed cell foam but preferably will comprise a unitary piece of sheet of closed cell foam material cut from foam sheet material stock or molded to shape. The closed cell foam materials may include a polyvinyl chloride, or polyethylene or similar closed cell synthetic foam. The left collar and right collar panels also include a pocket defined between the opposed webs making up these collar panels which are likewise adapted to receive buoyant flotation material, also preferably in unitary, one piece sheet form.

In accordance with the vest design of this invention, the side seams connecting side portions of the front panel to the left rear panel and right rear panel are sewn together using high strength thread sewn in a stitch to define a solid or continuous body portion. Once the wearer has inserted his arms into the vest, and the rear closure means is closed by an adult or another pair of hands, the vest has no side openings and cannot be removed by the wearer without the assistance of an adult. Because the arm holes are defined in a closed body portion of the vest, it is impossible for the side portions of the vest to open up, thereby loosing arm hole definition and safe securement of the vest to the upper torso of the wearer.

In accordance with a special feature of the flotation vest of this invention, each of the enlarged left and right collar panels with the buoyant flotation filling extend forwardly on either side of the neck opening to a pair of front seams disposed forwardly of the shoulders of the vest body. The front panel, left and right rear panels and left and right collar panels are all joined in common at the left and right front seams. The left and right collar panels are hingably connected to the vest body at the left and right front seams. The left and right collar panels are furthermore pivotally connected to each other along the free edge thereof including the releasable closures. Instead of being a single enlarged flotation panel, the bifurcated collar panels serves to cradle the head between the opposing sides of the collar panels which assume a V formation in use. This provides an improved safety feature because better cradling of the head in this manner keeps it in a face up position in the water. Moreover, the collar portions are affixed to a front top side of the vest in its back float condition rather than being attached at the shoulder or back. This provides better lift for the head in use.

The amount or volume of flotation material provided in the front panel may vary as is required to provide buoyancy for a weight associated with a child or person having a torso size accommodated by the size of the vest. In other words, the size of the vest is chosen to fit a size and weight range. A maximum weight for a child in the selected size range is determined. Thereafter, the volume of flotation material required for insertion in the front panel of the flotation vest is determined for this maximum weight so that if a wearer having the maximum weight falls forwardly, head first into the water, the amount and shape of buoyant flotation material causes rotation of the wearer in the water until the wearer is in a back floating, chest up position. By providing buoyancy to the front panel and not to the rear panels, the vest is imbalanced in the water and will turn most wearers to a chest up position in the water. Providing a properly effective amount of flotation material in the left and right collar portions extending from the forward upper portions of the vest, causes the head of the wearer to be lifted upwardly and preferably so both the face and the ears of the wearer are out of the water in use. The relative volume of the left and right collar panels with respect to the front panel is selected, so that the collar panels cooperate with the front vest panel to right the wearer into a back float position. The collar panels have sufficient buoyancy material to ensure a lifted head-up position for the wearer in the water.

The rear slide fastener closure for the vest body provides a number of distinct advantages. The zipper back vest is easy to put on a child. More particularly, the opened garment may be extended toward the child and the child can simply slip their raised arms through the arm holes defined in the vest body to effect installation. Thereafter, the adult assistant simply zippers up the entire back of the garment from the bottom edge of the left rear and right rear panels to the top of the left collar and right collar panels.

In accordance with the preferred embodiments a through-the-legs or crotch strap may also be included to provide additional assurances that the flotation vest will not ride up on the wearer in use. Also, in accordance with the preferred embodiment, waist adjustment straps may also be provided on each of the left rear and right rear panels so that the waist size of the vest may be made snug by the adult assistant. In addition, a top U-shaped strap member is provided to connect upper portions of the left and right collar panels to hold the rear sides of the vest together in the open condition to facilitate installation on a young child or wearer having special needs. The top strap also provides a raised hand hold strap for a rescuer to grab onto in the water. The top-strap may also be used for hanging the vest when not in use.

In accordance with the preferred embodiment, the front flotation panel portion of the vest may be provided with indicia attractive to a child such as faces of cartoon characters to encourage a child's desire to wear the vest and keep it on when needed.

Other objects and advantages of the present invention will become apparent from the following detailed description of the invention taken in conjunction with the drawings in which:

DETAILED DESCRIPTION OF THE PREFERRED EMBODIMENT

Figure 1:
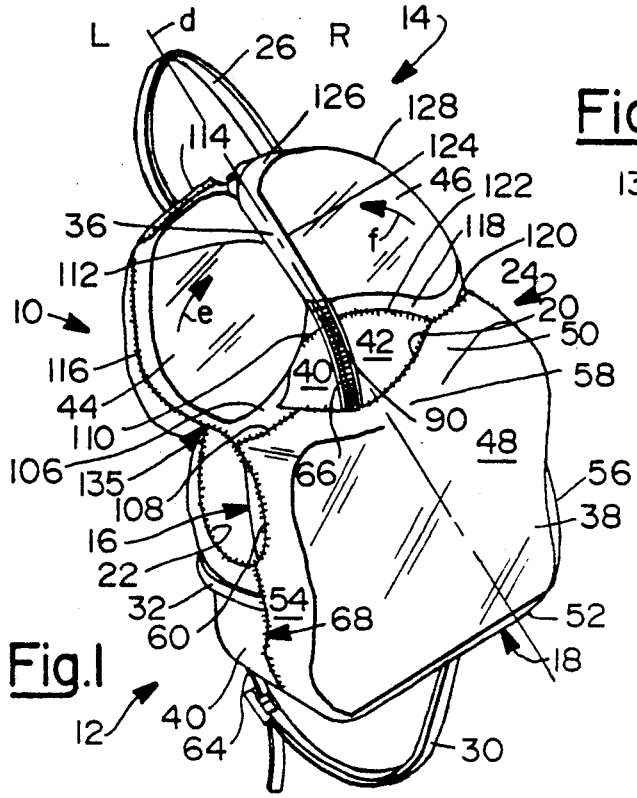
FIG. 1 is a perspective view of the new and improved flotation vest of this invention.

Referring now to FIGS. 1-6, the new and improved flotation vest of the present invention is generally designated by reference numeral 10. flotation vest 10 has a lower body portion 12 and an upper head support portion 14. Lower body portion 12 defines an inner body cavity 16 having a lower or bottom opening 18, a smaller top neck opening 20 and left and right arm hole openings 22 and 24, respectively. A top handle strap 26 extends from the free end 28 of head support portion 14. Vest 10 is additionally provided with a crotch strap 30 extending across the lower opening 18. Left and right waist adjustment straps 32 and 34 are also provided on the back sides of the vest body. An elongate side fastener or zipper 36 extends on the rear side of the vest from the bottom of the body portion to the free end 28 of the head support portion 14.

Figure 2:
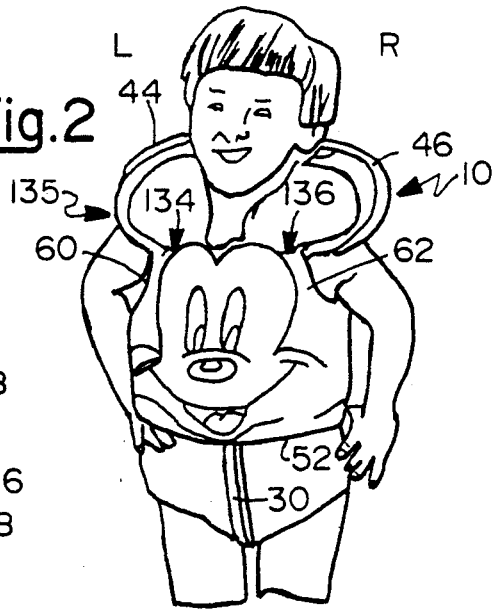
FIG. 2 is a perspective view of the new and improved flotation vest of this invention shown in use on a small child.

In the preferred embodiment depicted in the drawings, flotation vest 10 is intended for use by children. Accordingly, as shown in FIG. 2, children's decorations or indicia, such as cartoon characters or the like, may be provided on the front of the vest body portions 12 and 14 to make wearing the vest a more attractive proposition to a young person. All of the closures and fasteners for the flotation vest 10 are positioned at the back or rear side of the vest 10 out of reach of the child wearing the vest. Adult assistance is required to remove the vest once it has been put on the child, which is a major safety advantage provided by the structure of vest 10.

In greater detail now and as shown in FIGS. 1 and 3-6, the new and improved flotation vest 10 comprises a plurality of pliable fabric panels including a front panel 38, a left rear panel 40, a right rear panel 42, a left collar panel 44 and a right collar panel 46. Front panel 38 has a forward facing side or major surface 48 as well as a top or upper edge 50, a bottom or lower edge 52, a left side edge 54 and a right side edge 56. A central curving cut out or depression 58 is provided in the top edge 50 of front panel 38 which partly defines the front of top neck opening 20. The upper portion of left side edge 54 includes a generally semi-circular cut away portion 60 defining the front of left arm hole 22. A similar cutaway portion 62 is provided in the upper portion of right side edge 56 of front panel 38 as is more easily seen from FIGS. 2 and 4.

Figure 4:
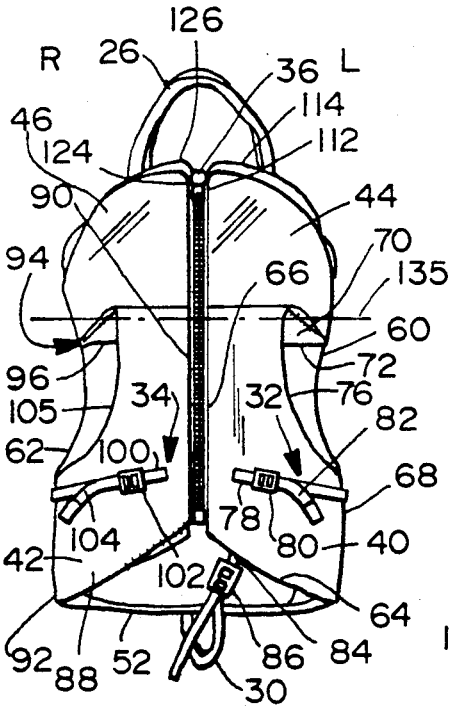
FIG. 4 is an elevated rear view of the new and improved flotation vest of the invention.

Referring now to FIGS. 1 and 4, left rear panel 40 is shown to include a bottom edge 64, an inwardly facing elongate left free edge portion 66, an outer left seam edge 68 and a top edge portion 70 having a generally straight portion 72 and a curving portion 74. A left arm hole forming back cut out 76 is also provided in left rear panel 40. A left side waist adjustment strap assembly 32 is provided including a mounting strap 78 mounting a buckle 80 adapted to receive elongate adjustable waist strap 52. A similar mounting strap 84 and buckle 86 project downwardly from bottom edge 64 which are adapted to receive crotch strap 30 extending from bottom edge 52 of front panel 38.

Right rear panel 42 is generally a symmetrical mirror image of left rear panel 40 and also includes a bottom edge 88, an inward facing free edge 90, an outward right side seam edge 92 and a top edge 94 including a straight portion 96 and a curved or curving portion 98. A right waist adjustment assembly 34 is provided by a mounting strap 100 and a buckle 102 adapted to receive the right waist strap 104. A right arm hole cut out portion 105 is also provided.

Left collar panel 44 includes a lower edge 106 having a straight portion 108 and a curving portion 110. A relatively straight inner free edge portion 112 extends from lower edge 106 to a top free edge 114 defining a part of the free end 28 of head support portion 14. A curved outer edge 116 extending between top edge 114 and straight portion 108 helps to define a lobe configuration for left collar panel 44.

Right collar panel 46 is a symmetrical mirror image of the left collar panel 44 and accordingly includes a corresponding lower edge 118 with a straight portion 120 and a curved portion 122, an inner free edge portion 124, a top edge 126 and a curved outer edge 128.

Referring to FIGS. 1 and 3-6, the various panels making up the flotation vest 10 are generally joined together along designated seam lines using a minimum seam width of about ⅜ to ½ inch. More particularly, a left side seam 130 joins left edge 54 of front panel 38 to left seam edge 68 of left rear panel 40. A right side seam 132 joins right side edge 56 of front panel 38 to right outer seam edge 92 of right rear panel 42. At the top of the body portion 12, a three way top left seam 134 joins the left hand of top edge 50 of front panel 38 to the straight portion 72 of top edge 72 of left rear panel 40 to define left arm hole 22. Top left seam 134 is positioned forwardly of a center of true shoulder position indicated at dotted line 135. Top left front seam 134 also hingably connects the straight portion 108 of lower edge 106 of left collar panel 44 to top edge 50 and top edge 72.

Figure 6:
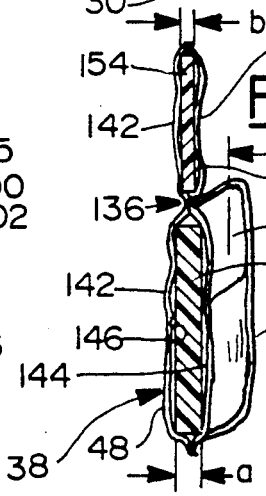
FIG. 6 is an elevated cross-sectional view of the new and improved flotation vest taken along view lines 6—6 in FIG. 3.

A similar three way front top right seam 136 shown in FIG. 6, joins the top right portion of top edge 50 of the front panel 38 to straight portion 120 of lower edge 118 of right collar panel 46 as well as to straight portion 96 along top edge 94 of right rear panel 42. The position of front right seam 136 is also disposed forwardly of a true centered shoulder line 135. The remaining curving portion 74 of top edge 70 of left rear panel 40 is hingedly connected to the curving portion 110 along lower edge 106 of left collar panel 44 by a left neck seam 138. The remaining curving portion 98 of top edge 94 of right rear panel 42 is hingedly connected to the curing portion 122 of lower edge 118 of the right collar panel 42, by a right neck seam 140.

In its assembled and sewn condition, the free edge portion 66 of left rear panel 40 is vertically aligned with the free edge 112 of left collar panel 44. Similarly, free edge portion 90 of right rear panel 42 is aligned with the free edge 124 of right collar panel 46. By virtue of this aligned construction a pair of elongate continuous opposing free edges are provided at the center of the back of the vest 10 for receiving releasable closure means preferably in the form of zipper 36. Zipper 36 is adapted to be closed by moving the slide 142 in an up direction to the top end of zipper 36 adjacent top edges 114 and 126.

Figure 5:
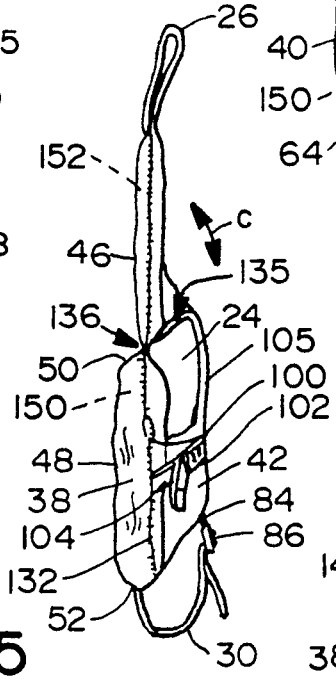
FIG. 5 is an elevated side view of the new and improved flotation vest of the invention.

Referring now to FIGS. 5-6, each of the panels includes inner and outer webs of woven nylon fabric 144, 146 which are assembled in overlying relationship and sewn about their respective peripheries to define each panel part. The intermediate portion of each panel part is thereby provided with a hollow area or pocket means 146. As shown in FIG. 6, the two webs 144 and 146 forming right rear panel 42 and front panel 38 are apparent. In accordance with this invention, the inner pocket means 146 of the front panel 38 left and right collar panels 44 and 46 are each filled with a shaped buoyant flotation insert members 150, 152 and 154 respectively.

Figure 3:
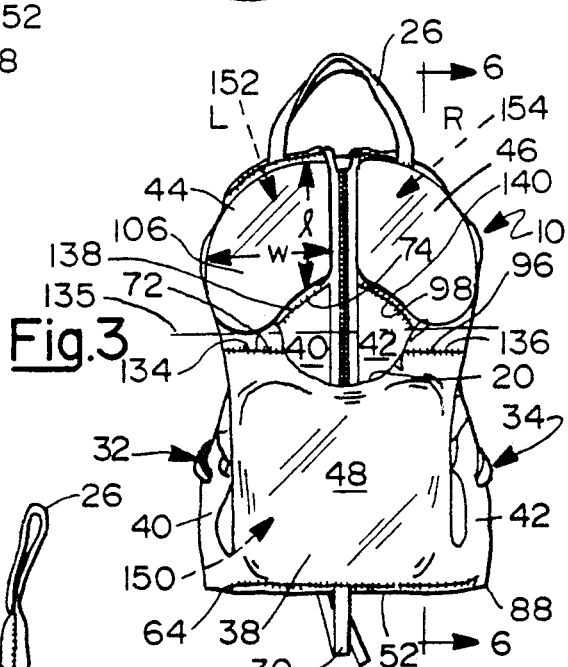
FIG. 3 is an elevated front view of the new and improved flotation vest of this invention.

As shown in FIGS. 3 and 6, flotation insert member 150 for front panel 38 is a unitary one piece member cut from a sheet of closed cell foam stock to a shape sized slightly less than but substantially corresponding to the shape of front panel 38. flotation insert 150 has a cross-sectional thickness dimension, a, as shown in FIG. 6, selected to provide the insert 150 with a specific volume for imparting a required buoyancy to the front part of the vest. Left collar flotation insert 152 and right collar flotation insert 154 are also of one piece foam construction and are symmetrical mirror images of each other. Inserts 152 and 154 for the collar panels are sized and shaped to substantially completely fill the interior pocket defined in these panels. The collar flotation inserts 152 and 154 have a cross sectional thickness dimension, b, as shown in FIG. 6 which may be less than thickness, a, of the front panel 150.

An important feature of the present invention is that no outwardly directed pulled forces act on the upper or lower end of the zipper member 36. The lower or bottom opening 18 is not constructed or tapered with respect to the remainder of the body cavity 16. Accordingly, if the vest is put on a properly sized child, no outward stressing along the zipper 36 will occur tending to cause unintentional opening or zipping. Moreover, even if the vest is tight or a snug fit on a child approaching maximum size and weight for the vest, outward forces will be directed circumferentially outwardly along the entire body portion of the vest. In addition, zipper 36 is preferably of a heavy duty type sewn into the vest with heavy duty machine stitching. For this reason, the zipper 36, once fully zippered will generally remain in this condition unless or until unzippered by an assisting adult.

In use, left and right collar panels 44 and 46 are free to pivot or rotate with respect to the front panel 38 as indicated by arrow c in FIG. 5. The left and right collar panels 44 and 46 may also flex or pivot toward and away from each other about a pivot axis d defined by the top portion of zipper 36 extending between collar panels 44 and 46 in the directions indicated by arrows e and f. When a child wearing vest 10 falls into the water, flotation insert 150 in front panel 38 causes the child to roll onto its back in a belly up, back float position. The child's head is lifted and rests on collar panels 44 and 46. The weight of the child's head tends to urge the collar panels 44, 46 into a cradling V-configuration wherein the zipper 36 is positioned at the apex of the V. The lobe-shaped flotation inserts 152-154 provided in the forwardly centered or positioned collar panels 44 and 46 extending forwardly on opposed sides of neck opening 20 tend to force the child's head and face into an elevated position out of the water and in a nose-up position as well which keeps the child's mouth and nose away from the water. For this reason the flexing, cradling support provided by the collar panels 44 and 46 combined with the non-removability provided by the back-closure, full length zippered vest features are considered to provide an improved safety flotation vest well suited for use with young children.

As has been mentioned above, the web layers 142, 144 of each of the panels are preferably made of a coated or uncoated woven fabric material having good physical strength, environmental properties and water-resistant properties such as nylons, polyolefins, polyesters or other woven fabrics. Especially preferred woven fabrics are nylon, pvc-reinforced nylon and polypropylene woven fabric materials. The closed cell foam materials for making the flotation inserts are known and can include polyvinyl chloride, polyethylene or other closed cell foam materials which are commercially available from several commercial sources. The manner of making each of the filled and unfilled panels and of joining the panels together to form the vest will be readily apparent to those skilled in this art.

In accordance with the present invention, the new and improved flotation vest 10 is provided with a number of redundant safety features. Top handle strap 26, for example, provides a convenient hand grip location for a life guard or rescuer to pull the wearer to safety, while the wearer remains in a safe position with his or her face out of the waves and water. Top handle strap 26 also tends to limit outward displacements or the possible separation distance between free edge 112 and free edge 124. The left and right waist adjustment assemblies 32 and 34 adjust the size and fit of the vest 10 to the wearer's frame. A good fit means better comfort which in turn means that a child will be contented to keep the flotation vest on for longer periods of time when the child is on or near the water. The crotch strap assembly 30 helps to ensure that a child will not slip out the bottom opening 18 of the vest. The complete surrounding chest and shoulder engagement provided by the zippered vest bodice is generally effective to keep a child from slipping out of the vest. The crotch strap 30 provides additional assurance that this will not occur and also contributes to giving the wearer a more comfortable, relatively immobilized snug fit.

Throughout this discussion reference has been made to a preferred embodiment wherein the flotation vest is adapted for use on small children weighing about 50 pounds or less. It will be readily apparent to those skilled in this art that the same principles of construction may be employed and the sizes of the vest varied, i.e., scaled up or down, to adapt the new and improved more comfortable flotation vest 10 to a different group of intended wearers such as adults and adolescents as well as infants and children. The volume and buoyancy values for the flotation inserts 150, 152 and 154 may be varied as required, but adjustments of this kind are within the knowledge or skill of those persons familiar with this art.

Although the present invention has been described with reference to a preferred embodiment, modifications or changes may be made therein by those skilled in this art. For example, although the releasable closure means for the free edges at the back of the vest was shown to be a zipper in this application, other releasable closure means may be used provided they will not come undone accidentally in use. Illustrative substitutes may include a plurality of buttons and cooperating button holes. Instead of cutting the flotation inserts 150, 152 and 154 from foam sheet stock, molded one-piece inserts or chopped closed cell foam filler materials may be added to the panel pockets to provide the requisite buoyancy. Instead of woven fabrics the webs may be made from nonwoven films. Instead of sewing and stitching seams, adhesive bonding or thermal or ultrasonic welding or bonding may be employed, provided the seams having requisite strength and toughness are produced by these alternate methods. All such obvious modifications may be made herein without departing from the scope and spirit of the present invention as defined by the appended claims.

We claim:

1. A flotation vest comprising: a plurality of pliable panels including a front panel, a left rear panel and a right rear panel, said left rear panel and said right rear panel each being joined to said front panel along respective adjacent top edges and side edges to define an integral vest body having a solid front, a split open back, a top neck opening and a pair of side arm holes, said vest further including a left collar panel hingedly connected to the vest body adjacent said neck opening and a right collar panel hingedly connected to the vest body adjacent said neck opening, said front panel, left collar panel and right collar panel each including internal pocket means having buoyant flotation material disposed therein; said vest further including a left rear free edge portion extending continuously from a free end of said left collar panel to a bottom edge of said left rear panel and an opposed right rear free edge portion extending continuously from a free end of said right collar panel to a bottom edge of said right rear panel and releasable closure means for selectively joining and disjoining the left rear free edge portion and the right rear free edge portion together to thereby secure or release the flotation vest to or from a wearer, respectively.

2. A flotation vest as defined in claim 1 wherein the releasable closure means is positioned so that it requires the aid of another person for operation.

3. A flotation vest as defined in claim 1, wherein said releasable closure means comprises a slide fastener.

4. A flotation vest as defined in claim 1 wherein said front panel left rear panel, right rear panel, left collar panel and right collar panel are each defined by a pair of webs of material.

5. A flotation vest as defined in claim 4, wherein said pair of webs are formed of a woven fabric material.

6. A flotation vest as defined in claim 5, wherein said woven fabric is selected from coated or uncoated nylon, reinforced nylon, polyester, or polyolefin woven fabrics, pvc-reinforced nylon and polypropylene woven fabric materials.

7. A flotation vest as defined in claim 1, wherein said buoyant flotation material comprises a unitary sheet of material.

8. A flotation vest as defined in claim 7, wherein said sheet material comprises a closed cell foam selected from polyvinyl chloride, polyethylene and polypropylene foam materials.

9. A flotation vest as defined claim 1 further comprising a adjustable length crotch strap extending between a lower edge of said front panel and a lower edge position of said left rear panel or said right rear panel and means for adjusting the length of said crotch strap disposed on said left or said right rear panel.

10. A method for making a flotation vest comprising:

providing a vest body including a front panel, a left rear panel and a right rear panel, said front panel, left rear panel and right rear panel being combined by joining appropriate ones of said panels to form a top left seam, a top right seam, a left side seam and a right side seam in such manner as to form an open back, solid front vest having a top neck opening and left and right arm hole openings;

providing a head support portion including a left collar panel and a right collar panel;

joining the left collar panel in a hingeable manner to the top left seam adjacent the top neck opening and joining the right collar panel in a hingeable manner to the top right seam, said top left seam and said top right seam being forwardly offset to a front side of said top neck opening; said front panel, said left collar panel and said right collar panel each having a flotation insert of buoyant flotation material disposed in an interior pocket portion defined therein; and providing a rear releasable closure means extending continuously from a lower edge of said left and right rear panels to upper free end portions of said left and right collar panels, said rear releasable closure means being positioned so that it requires assistance of another person for operation.

11. A flotation vest comprising:

a plurality of pliable panels joined together to define an integral vest body including a front portion, a back portion, a top neck opening and left and right arm hole openings, said vest body including a left front seam joining an upper left hand side of the front portion to the back portion and a right front seam joining an upper right hand side of the front portion to the back portion, said left front seam and said right front seam being forwardly offset toward the front of the neck opening and extending between said neck opening and said left and said right arm holes, respectively, said flotation vest further including a head support portion having a left collar portion and a right collar portion hingeably connected to said vest body at said left front seam and said right front seam, respectively, and about said neck opening such that said left and right collar portions of said head support portion extend forwardly on opposed sides of said neck opening; said vest further including buoyant flotation material being disposed in said front portion of the vest body and in said head support portion; and means for securing the vest to an upper body of a wearer.

12. A vest as defined in claim 11, wherein said back portion is split in a vertical, lengthwise direction and said head support portion is split in a vertical, lengthwise direction intermediate the left and the right collar portions to define a pair of continuous rear opposing free edges, and a releasable closure means is provided along the opposing rear free edges to open and close the vest.

* * * * *